US009932806B2

(12) United States Patent
Stewart et al.

(10) Patent No.: US 9,932,806 B2
(45) Date of Patent: Apr. 3, 2018

(54) APPARATUS, SYSTEM AND METHOD FOR REDUCING GAS TO LIQUID RATIOS IN SUBMERSIBLE PUMP APPLICATIONS

(71) Applicant: Summit ESP, LLC, Tulsa, OK (US)

(72) Inventors: Joseph Stewart, Stillwater, OK (US); Wesley John Nowitzki, Broken Arrow, OK (US); John Vanderstaay Kenner, Houston, TX (US)

(73) Assignee: Summit ESP, LLC, Tulsa, OK (US)

( * ) Notice: Subject to any disclaimer, the term of this patent is extended or adjusted under 35 U.S.C. 154(b) by 319 days.

(21) Appl. No.: 14/696,537

(22) Filed: Apr. 27, 2015

(65) Prior Publication Data

US 2015/0308245 A1 Oct. 29, 2015

Related U.S. Application Data

(60) Provisional application No. 61/985,044, filed on Apr. 28, 2014.

(51) Int. Cl.
*E21B 43/12* (2006.01)
*E21B 47/00* (2012.01)

(52) U.S. Cl.
CPC ..... *E21B 43/128* (2013.01); *E21B 47/0007* (2013.01)

(58) Field of Classification Search
CPC ..... E21B 43/128
See application file for complete search history.

(56) References Cited

U.S. PATENT DOCUMENTS

| | | | | |
|---|---|---|---|---|
| 4,330,306 | A | 5/1982 | Salant | |
| 4,481,020 | A | 11/1984 | Lee et al. | |
| 4,981,175 | A * | 1/1991 | Powers | B01D 19/0052 166/105.5 |
| 5,628,616 | A | 5/1997 | Lee | |
| 5,742,500 | A | 4/1998 | Irvin | |
| 6,167,965 | B1 | 1/2001 | Bearden et al. | |
| 6,273,129 | B1 | 8/2001 | Chavand et al. | |
| 6,312,216 | B1 | 11/2001 | Falcimaigne | |
| 6,464,464 | B2 | 10/2002 | Sabini et al. | |
| 6,755,250 | B2 | 6/2004 | Hall et al. | |
| 7,647,136 | B2 | 1/2010 | McDowell | |

(Continued)

*Primary Examiner* — Robert E Fuller
*Assistant Examiner* — Steven A MacDonald
(74) *Attorney, Agent, or Firm* — Frederic Dorwart, Lawyers PLLC; Penina Michlin Chiu

(57) ABSTRACT

An apparatus, system and method for reducing gas to liquid ratios in submersible pump applications are described. A method for reducing a gas to liquid ratio (GLR) in a pumped fluid includes pumping a gas laden fluid to a surface of a subsurface formation using a downhole electric submersible pump (ESP) assembly including an ESP pump and an ESP motor, monitoring one of a load of the ESP motor, intake pressure of the ESP pump, temperature of the gas laden fluid, or a combination thereof to obtain ESP assembly condition data, determining whether a GLR of the gas laden fluid exceeds a predetermined allowable maximum based on the ESP assembly condition data, injecting liquid from an external source into the gas laden fluid, and varying a rate that the external liquid is injected based on the GLR so determined.

12 Claims, 4 Drawing Sheets

(56) References Cited

U.S. PATENT DOCUMENTS

| | | | | |
|---|---|---|---|---|
| 7,806,186 | B2 * | 10/2010 | Brown | E21B 43/122 166/105 |
| 8,436,559 | B2 | 5/2013 | Kidd et al. | |
| 8,564,233 | B2 | 10/2013 | Kidd et al. | |
| 8,774,972 | B2 | 7/2014 | Rusnak et al. | |
| 2006/0096760 | A1 * | 5/2006 | Ohmer | E21B 43/121 166/304 |
| 2007/0144738 | A1 * | 6/2007 | Sugiyama | E21B 23/02 166/250.07 |
| 2009/0151953 | A1 * | 6/2009 | Brown | E21B 43/122 166/335 |
| 2009/0187382 | A1 | 7/2009 | Conroy et al. | |
| 2010/0319926 | A1 | 12/2010 | Reid | |
| 2011/0301766 | A1 | 12/2011 | Higgins et al. | |
| 2013/0175030 | A1 | 7/2013 | Ige et al. | |
| 2013/0331963 | A1 | 12/2013 | Ahangar et al. | |
| 2014/0121789 | A1 | 5/2014 | Brandes et al. | |
| 2014/0368152 | A1 | 12/2014 | Pasche et al. | |

* cited by examiner

APPARATUS, SYSTEM AND METHOD FOR REDUCING GAS TO LIQUID RATIOS IN SUBMERSIBLE PUMP APPLICATIONS

CROSS REFERENCE TO RELATED APPLICATIONS

This application claims the benefit of U.S. Provisional Application No. 61/985,044 to Stewart et al., filed Apr. 28, 2014 and entitled "APPARATUS, SYSTEM AND METHOD FOR REDUCING GAS TO LIQUID RATIOS IN SUBMERSIBLE PUMP APPLICATIONS," which is hereby incorporated by reference in its entirety.

BACKGROUND OF THE INVENTION

1. Field of the Invention

Embodiments of the invention described herein pertain to the field of submersible pump assemblies. More particularly, but not by way of limitation, one or more embodiments of the invention enable an apparatus, system and method for reducing gas to liquid ratios in submersible pump applications.

2. Description of the Related Art

Submersible pump assemblies are typically used to artificially lift fluid to the surface in deep wells such as oil, water or gas wells. A typical electric submersible pump (ESP) assembly is located deep in the ground and, from upstream to downstream, consists of downhole sensors, an electrical motor, seal section, pump intake and pump. The motor, seal, intake and pump are all connected together with shafts that run through the center of the ESP assembly components. The electrical motor supplies torque to the shafts, which provides power to the pump. Production tubing connects the pump to piping or storage tanks at the surface of the well.

Centrifugal pumps are often used in ESP applications for lifting well fluid to the surface. Centrifugal pumps impart energy to a fluid by accelerating the fluid through a rotating impeller paired with a stationary diffuser. The rotation confers angular momentum to the fluid passing through the pump. The angular momentum converts kinetic energy into pressure, thereby raising the pressure on the fluid and lifting it to the surface. Multiple stages of impeller and diffuser pairs may be used to further increase the pressure.

Conventional centrifugal pumps are designed to handle fluid consisting mainly of liquids. However, well fluid often contains gas in addition to liquid, and currently available submersible pump systems are not appropriate for pumping fluid with a high gas to liquid ratio. When pumping gas laden fluid, the gas may separate from the other fluid due to the pressure differential created when the pump is in operation. If there is a sufficiently high gas to liquid ratio (GLR), typically around 10% to 15% gas volume fraction, the pump may experience a decrease in efficiency and decrease in capacity or head (slipping). If gas continues to accumulate on the suction side of the pump impeller, the gas may entirely block the passage of other fluid through the impeller. When this occurs the pump is said to be "gas locked" since proper operation of the pump is impeded by the accumulation of gas. As a result, careful attention to gas management in submersible pump assemblies is needed in order to improve the production of gas laden fluid from subsurface formations.

Currently, attempts are sometimes made to remove gas from produced fluid prior to the fluid's entry into the pump intake. For example, gas separators are sometimes implemented as an additional pump assembly component for this purpose. However it is often infeasible, costly or too time consuming to ascertain the correct type of pump and separator combination which might be effective for a particular well, and even if the correct arrangement is ascertained, the separator may not remove enough gas to prevent a loss in efficiency and/or prevent gas locking. Alternatively, perforations in the well casing are sometimes placed above the pump intake and implemented with a shroud. The shroud forces well fluid deeper into the well before entering the pump intake, a portion of the gas breaking out of the fluid in the process. A drawback to the use of a shroud is that conventional shrouds are prone to leaks. If well fluid were to leak directly into the pump, the fluid entering the well casing above the pump intake would bypass the motor, which would be at risk of overheating or failure due to the lack of cool, fresh flowing fluid passing-by during operation.

The motor of an ESP assembly is conventionally operated using a variable speed drive (VSD), which is controlled by a well operator with a VSD controller user interface located at the surface of the well. Typically, if the GLR becomes too high, this may be detected by the VSD controller since the load on the motor becomes lighter, the motor does not pull as much amperage and the temperature of the motor increases. In response, the pump operator would typically modify the speed of the pump's motor or hold more back pressure on the tubing in an attempt to prevent slipping or gas locking. However, this approach only meets with somewhat limited success, as the high gas to liquid ratio remains in the produced fluid.

Thus, conventional ESP assemblies are not well suited for pumping fluid with a high gas to liquid ratio. Therefore, there is a need for an apparatus, systems and method for reducing gas to liquid ratios in submersible pump applications.

BRIEF SUMMARY OF THE INVENTION

One or more embodiments of the invention enable an apparatus, system and method for reducing gas to liquid ratios (GLR) in submersible pump applications.

An apparatus, system and method for reducing GLR in submersible pump applications are described. An illustrative embodiment of a liquid-injection apparatus for an electric submersible pump (ESP) assembly comprises a multistage centrifugal pump submerged in a well comprising gas laden fluid, an ESP motor operatively coupled to the multistage centrifugal pump so as to turn the multistage centrifugal pump, a pump inlet fluidly coupling the gas laden fluid and the multistage centrifugal pump, at least one capillary extending between a liquid supply external to the well and the pump inlet, a liquid injection pump inserted along the capillary, and at least one variable speed drive (VSD) system sensingly coupled to the motor and controllably coupled to the liquid injection pump, wherein the at least one VSD adjustably controls a flow of liquid from the liquid supply downhole through the capillary. In some embodiments, the liquid supply comprises a portion of the gas laden fluid that has been previously produced from the well and de-gassed. In certain embodiments, the gas laden fluid comprises a mixture of water, natural gas and oil, and the liquid comprises water. In some embodiments, one of the at least one capillary terminates proximate an inlet port of the pump inlet and a side of the one of the at least one capillary proximate the inlet port comprises a nozzle.

An illustrative embodiment of a method for reducing a gas to liquid ratio (GLR) in a pumped fluid comprises pumping a gas laden fluid to a surface of a subsurface formation using a downhole electric submersible pump (ESP) assembly comprising an ESP pump and an ESP motor, monitoring one of a load of the ESP motor, intake pressure of the ESP pump, temperature of the gas laden fluid, or a combination thereof to obtain ESP assembly condition data, determining whether a GLR of the gas laden fluid exceeds a predetermined allowable maximum based on the ESP assembly condition data, injecting liquid from an external source into the gas laden fluid, and varying a rate that the external liquid is injected based on the GLR so determined. In some embodiments, the method further comprises degassing at least a portion of the gas laden fluid produced by the downhole ESP assembly to form the liquid, and storing the liquid at the external source. In certain embodiments, the rate is between 25 and 5,000 barrels per day. In some embodiments, the load of the ESP motor is monitored and the GLR is determined to exceed the predetermined allowable maximum when the ESP motor is under-loaded. In certain embodiments, the GLR is estimated based on the downhole condition data, and an estimated GLR value is used to determine whether the GLR exceeds a predetermined allowable maximum. In some embodiments, the predetermined allowable maximum is a preset GLR set point. In some embodiments, the liquid is injected directly into an inlet port of an intake of centrifugal pump. In certain embodiments, the liquid is injected proximate to a well perforation. In some embodiments, the liquid is injected downstream of an intake of the ESP pump. In certain embodiments, the liquid is injected one of proximate the ESP motor, upstream of the ESP motor, or a combination thereof.

An illustrative embodiment of a pump gas to liquid ratio (GLR) management system comprises an electric submersible pump (ESP) assembly downhole in a well comprising a gas laden fluid, a variable speed drive (VSD) system controllably coupled with the ESP assembly, the VSD system comprising ESP assembly operation data, a liquid injection pump comprising at least two modes of operation, wherein a particular mode of the at least two modes is settable by the VSD system, and the liquid injection pump fluidly coupling an external liquid supply and an annulus of the ESP assembly, wherein a rate the external liquid supply flows to the annulus is adjustable based on the particular mode of the liquid injection pump set by the VSD system. In some embodiments, the liquid injection pump comprises a positive displacement pump and a capillary. In some embodiments, the capillary terminates proximate an intake port of the ESP pump assembly. In certain embodiments, the at least two modes of operation comprise on, off, rate increase and rate decrease.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of the invention will be more apparent from the following more particular description thereof, presented in conjunction with the following drawings wherein.

Figure 1:
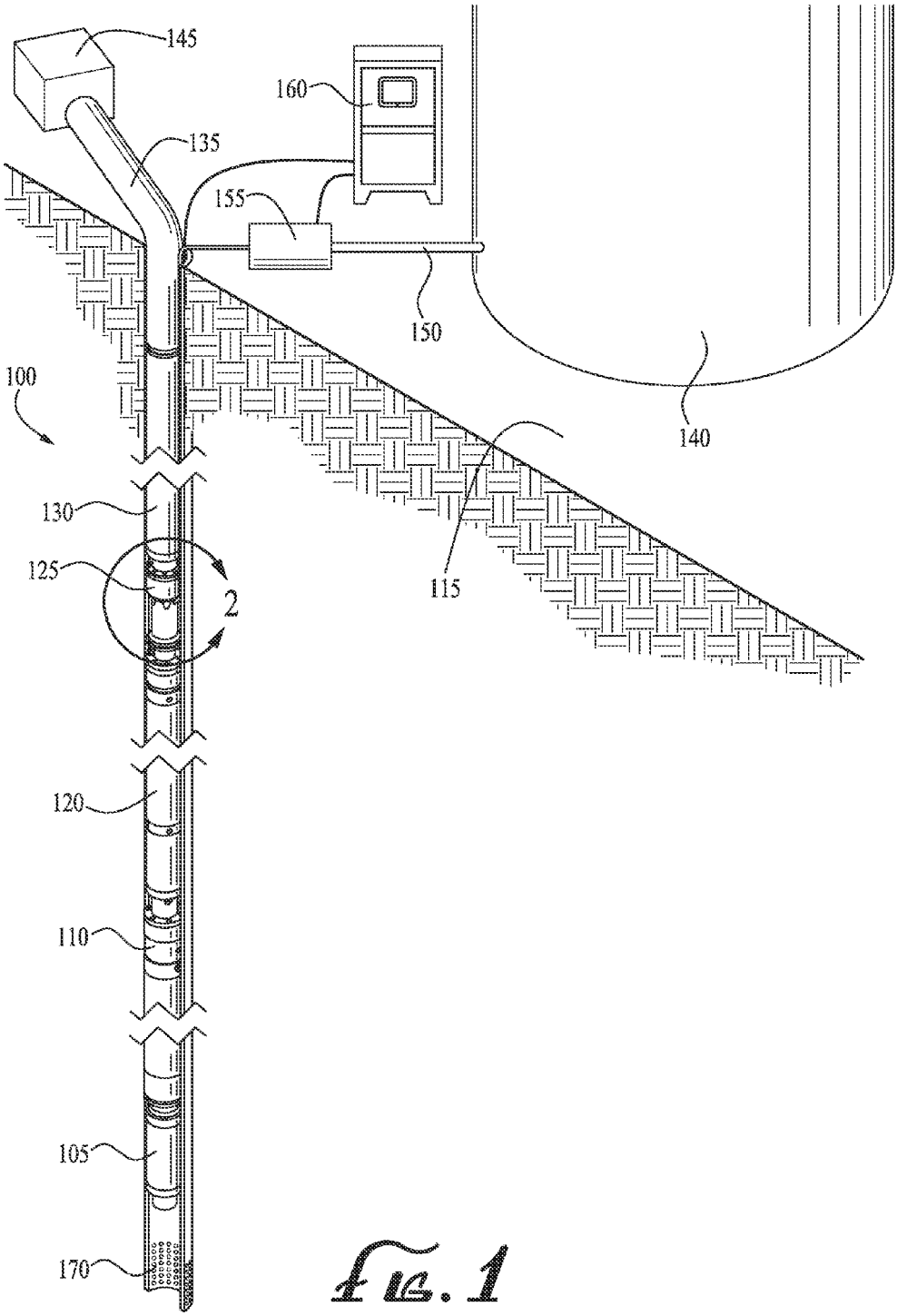
FIG. 1 is a perspective view of a gas to liquid ratio (GLR) management system of an illustrative embodiment.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

An apparatus, system and method for reducing gas to liquid ratios in submersible pump applications will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a capillary includes one or more capillaries.

"Coupled" refers to either a direct connection or an indirect connection (e.g., at least one intervening connection) between one or more objects or components. The phrase "directly attached" means a direct connection between objects or components.

"Downstream" refers to the direction substantially with the principal flow of pumped well fluid when the submersible pump assembly is in operation.

"Upstream" refers to the direction substantially opposite the principal flow of pumped well fluid when the submersible pump assembly is in operation.

"External" refers, with respect to liquid injected into a well, to liquid separate from the then-pumped well fluid. The "external" liquid may have been previously removed from the well, degassed, and for example stored in a tank near the surface of the well. Degassing of a produced fluid at the surface of a well is a procedure well known to those of skill in the art, and may, for example include pressure reduction and/or heating of the produced fluid to reduce the solubility of the gas. In other embodiments, the external liquid may originate from a source distinct from the well. In instances where the external liquid originates from a source distinct from the well, the liquid may, for example, be transported by truck, pipeline or rail to a storage tank at the surface of the well.

As used herein, "high" with respect to a gas to liquid ratio (GLR), refers to 10% or more gas to liquid ratio by volume.

One or more embodiments of the invention provide an apparatus, system and method for reducing GLR in submersible pump applications. Illustrative embodiments improve the characteristics of pumped gas-laden fluid to correspondingly improve pump operation. Using the apparatus, system and method of illustrative embodiments, the pressure of fluid pumped from subsurface formations may be increased by injection of additional liquid, in order to decrease the GLR of the gas laden fluid. Injecting gas-free liquid into the pump inlet may also increase the overall percentage of liquid in the pumped fluid.

A capillary or flowline may connect a source of injection liquid, which injection liquid may include water or mineral oil, to an inlet port, annulus of the pump and/or well perforations, allowing the external liquid to be injected by an injection pump, through the capillary, and into the ESP pump intake on demand (with variation in rate). The injection liquid may also include chemical treatments, such as a scale inhibitor. A variable speed drive (VSD) may control the injection pump in order to adjust the flow of external liquid as-needed to reduce GLR, depending on ambient circumstances. The VSD may be the same VSD that controls the motor of the ESP pump. Illustrative embodiments of the invention may reduce the GLR of pumped fluid, which may decrease slipping (increase head), reduce or eliminate gas locking and may increase performance of the downhole pump.

While for illustration purposes, illustrative embodiments are described herein in terms of a downhole oil well, which wells generally contain fluid having a combination of oil, water and/or natural gas, and wherein water may be used as the liquid to be injected into the pump intake to reduce GLR, nothing herein is intended to limit the invention to those embodiments. Other liquids, such as mineral oil and/or chemical treatments, may also be injected into a well to reduce GLR, depending on the well fluid being pumped and ambient well conditions.

FIG. 1 is an exemplary submersible pump assembly of an illustrative embodiment including a liquid injection system. Electric submersible pump (ESP) assembly 100 may be located in an underground well and/or subsurface formation. As shown in FIG. 1, ESP assembly 100 is in a vertical orientation within the ground, but ESP assembly 100 may instead be in a horizontal configuration or angled somewhere between the vertical and horizontal. ESP assembly 100 may include sensor 105 to detect the temperature, speed, pressure and/or similar information of electric motor 110, and communicate that information to VSD system 160 located on surface 115. Electric motor 110 may be an electric submersible motor for use in downhole applications, such as a two-pole, three-phase squirrel cage induction motor. Seal section 120 protects motor 110 from fluid ingress, and provides a fluid barrier between the well fluid and motor oil. Motor oil resides within seal section 120, which motor oil is kept separated from the well fluid. In addition, seal section 120 supplies motor oil to motor 110, provides pressure equalization to counteract expansion of motor oil in the well bore and carries the thrust of ESP pump 130.

Gas laden fluid enters the assembly at pump intake 125, and is lifted to the surface with production tubing 135. ESP pump 130 may be a multistage centrifugal pump including two or more impeller and diffuser stages, stacked in series around the shaft of ESP pump 130. Shafts (not shown) run through the center of motor 110, seal 120, intake 125 and ESP pump 130 and are connected such that motor 110 may turn ESP pump 130 and cause well fluid to be drawn into ESP pump 130 and lifted to surface 115. Production tubing 135 may carry produced well fluid to storage receptacle 145 or may connect to other pipelines to gather and distribute the produced fluid. In embodiments where the produced fluid is used as the source of external liquid to be re-injected into the well to reduce GLR, produced gas laden fluid may first be de-gassed and then delivered into tank 140 on surface 115.

Capillary 150 may be a capillary line or flowline extending between injection liquid tank 140 and pump intake 125. In some embodiments, capillary 150 may be between a quarter-inch and one-inch stainless steel tube or pipe delivering water or other liquid on demand to pump intake 125. A single capillary 150 or multiple capillaries 150 may be employed, for example a single capillary branching out to each inlet port 205 (shown in FIG. 2), a single capillary 150 leading to a single inlet port 205, multiple capillaries 150 leading to multiple inlet ports 205, or one or more capillaries 150 terminating at different depths within the well. The size, length and number of capillaries 150 may be based on space limitations and/or anticipated injection rate requirements. Capillary 150 may be attached to the outer surface of portions of production tubing 135, ESP pump 130, pump intake 125, seal section 120, motor 110 and/or sensors 105 with metal banding as-needed to hold capillary 150 in place.

Figure 2:
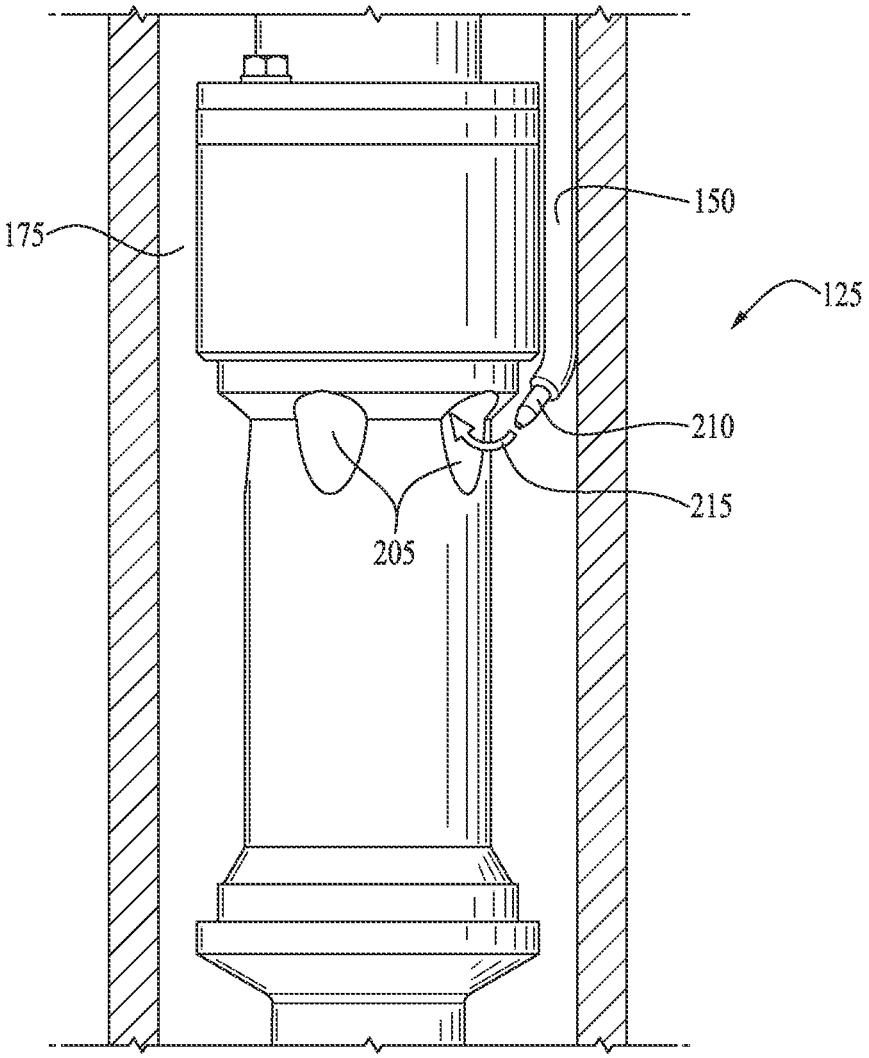
FIG. 2 is an enlarged side elevation view of an intake of a submersible pump assembly of an illustrative embodiment.
Figure 4:
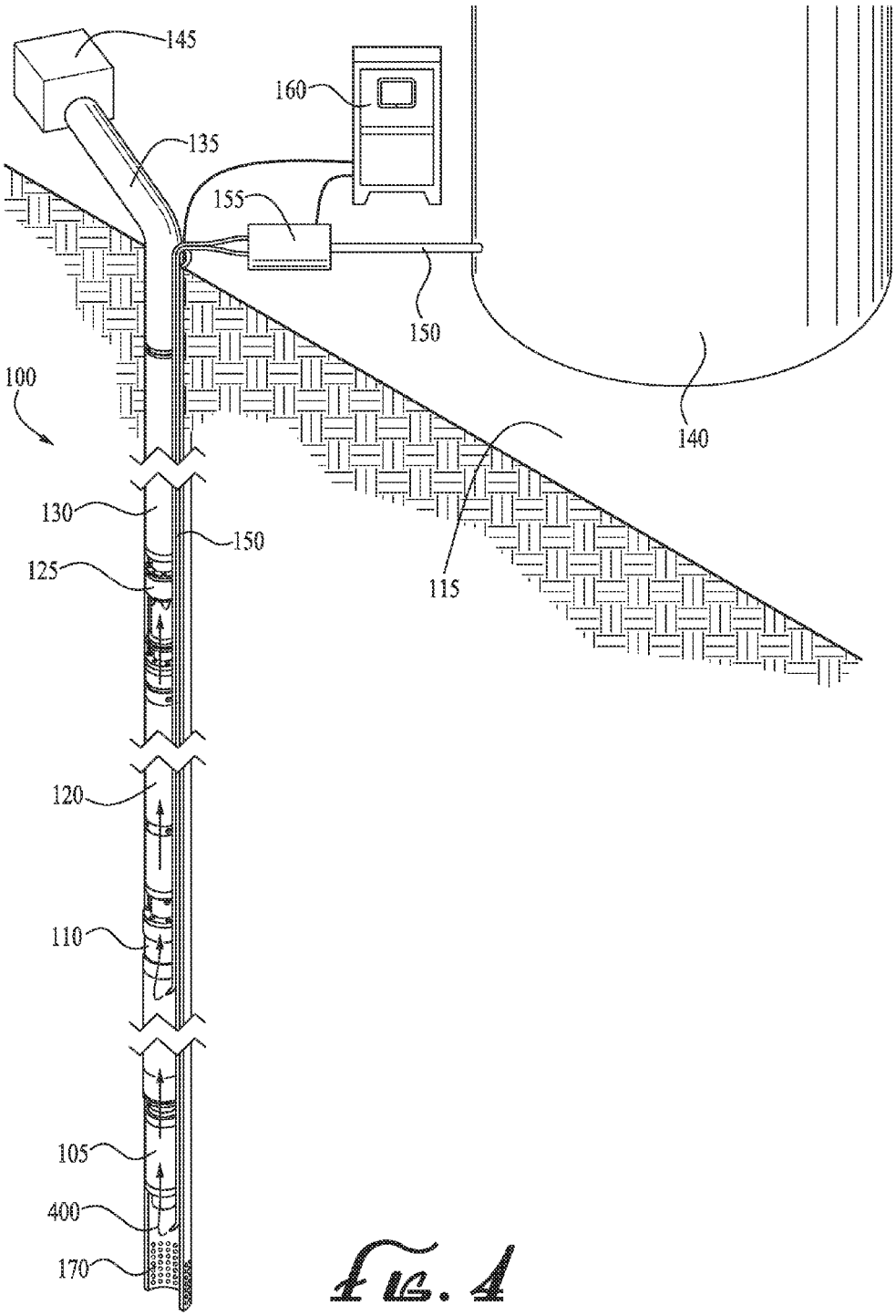
FIG. 4 is a perspective view of a GLR management system of an illustrative embodiment having capillaries terminating proximate the downhole motor and well perforations.

Capillary 150 may terminate at inlet port 125 for example as shown in FIG. 2, or capillary 150 may terminate in a location other than inlet port 205, for example as illustrated in FIG. 4. As shown in FIG. 4, capillary 150 may terminate proximate perforations 170 and/or near motor 110, such as adjacent to, proximate and/or just upstream of motor 110. Where injected liquid is injected proximate or upstream of motor 110, after injection, cooling injected liquid 400 may pass by and cool motor 110 on its way back downstream towards intake 125. In some embodiments, capillary 150 may terminate short of pump intake 125, such as proximate downhole production tubing 135 or downstream portions of ESP pump 130. In some embodiments, injection liquid may be forced down into annulus 175 without the need for capillary 150. The decision to employ capillary 150 may depend on the cost of capillary 150 as compared to the increase in pump efficiency realized from the increased precision in the injected liquid's delivery location capillary 150 may afford.

FIG. 2 illustrates an exemplary pump intake of illustrative embodiments. As show in FIG. 2, pump intake 125 includes one or more inlet ports 205 and/or annulus 175 through which fluid may enter centrifugal pump 130. One or more capillaries 150 may terminate proximate one or more inlet ports 205, such that liquid may be injected directly into one or more inlet ports 205. Liquid flow path 215 illustrates an exemplary "direct" injection liquid flow. In some embodiments, nozzle 210 may be included on a side of capillary 150 nearest to inlet port 205 or other delivery location and/or capillary 150 may be angled or bent on one end (side), to assist in guiding the liquid directly into or proximate inlet port 205 or other delivery location. Liquid from capillary 150 may be injected directly into inlet port 205, for example as illustrated in FIG. 2, so as to maximize the effectiveness of the injected liquid. In some embodiments, injected liquid may be delivered upstream or downstream of inlet port 205, for example proximate or in the vicinity of motor 110 as shown in FIG. 4 and/or within pump annulus 175. Pump annulus 175 may extend from production tubing 135 to below downhole sensors 105 between ESP assembly 100 and the well casing. A particular location within annulus 175 for delivery of injected liquid may be selected based on efficiency of the injection location as compared to the cost of employing the delivery mechanism to that location. In additional, delivering injected liquid at or below motor 110 may assist in cooling motor 110, since after injection, the cooling injection liquid 400 may flow past motor 110 on its way to pump intake 125.

Returning to FIG. 1, liquid injection pump 155 which may be a positive displacement pump, an electric motor coupled to a multistage centrifugal pump, or any other pump or device capable of delivering mass flow to intake 125 or annulus 175 on demand, may be interposed along the portion of capillary 150 on surface 115. Liquid injection pump 155 may be belt or chain driven and pump liquid from tank 140 through capillary 150, as is needed to reduce GLR. In some embodiments, liquid injection pump 155 may inject fluid into the well without the need for capillary 150. VSD system 160, which may be located on surface 115, may be used to control the speed of liquid injection pump 155. VSD system 160 may also receive information from sensors 105 and control motor 110 of ESP assembly 100. In other embodiments two or more VSD systems 160 may be employed, which VSD systems 160 may be in communication with one other, or an operator may compile information from two distinct VSD systems 160 and modify the flow of injected liquid accordingly. VSD system 160 may include a VSD, VSD controller (user interface) and connections to sensors and/or pump motors, such as downhole sensors 105, motor 110 and/or injection pump 155, as is well known to those of skill in the art.

A human operator may review the current condition of motor 110 and/or ESP pump 130 as reflected on the corresponding submersible pump assembly VSD system 160 and manually modify the flow of liquid through capillary 150 and/or delivered to pump intake 125 in response, by altering the speed of the motor of liquid injection pump 155 on the fluid injection pump VSD system 160. Alternatively, VSD system 160 for liquid injection pump 155 may be programmed to automatically adjust the flow of injection liquid upon receipt of information indicating that the GLR is too high (and pump performance is correspondingly being affected). For example, a control loop feedback mechanism such as a Proportional Integral Derivative (PID) controller may be employed. In instances where VSD system 160 for liquid injection pump 155 is the same VSD system 160 controlling ESP pump 130, information regarding the current status of electric motor 110 may be used by VSD system 160 to calculate the rate that liquid should be injected into intake 125 and/or annulus 175 by liquid injection pump 155. In instances where two separate VSD systems 160 control the motors attached to ESP pump 130 and liquid injection pump 155 respectively, the two VSD systems 160 may be in communication using a wired or wireless connection, for example, an Ethernet, cellular, wifi or radio connection.

Figure 3A:
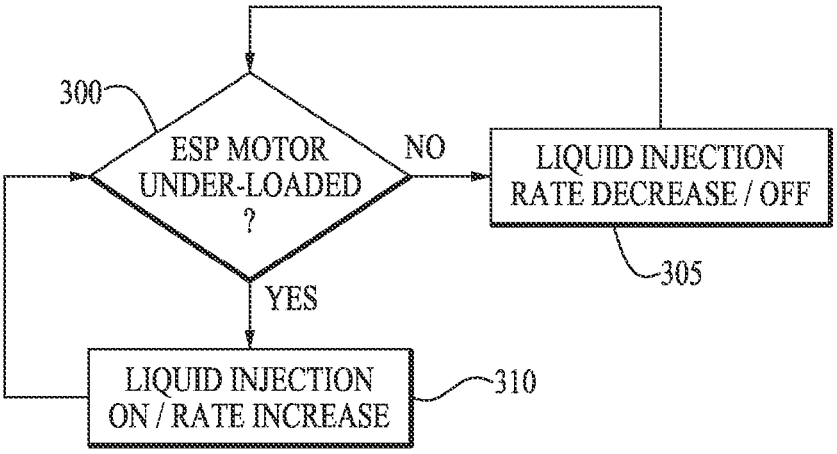
FIG. 3A is a flowchart of a method of an illustrative embodiment for reducing GLR in a pumped fluid.
Figure 3B:
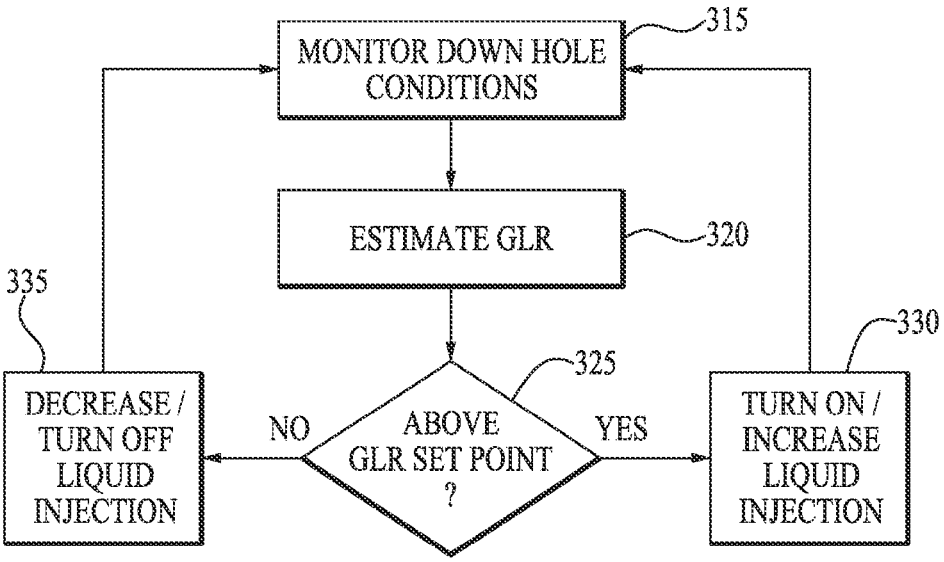
FIG. 3B is a flowchart of a method of an illustrative embodiment for reducing GLR in a pumped fluid.

FIGS. 3A and 3B show exemplary methods of reducing GLR of illustrative embodiments. In FIG. 3A, a high GLR may be assumed from motor 110 under-load condition. At step 300, VSD system 160 may sense an under-load, for example by checking sensor 105 reading at set intervals, such as continuously, every 10 minutes or every hour. If a motor 110 under-load condition is sensed, then VSD system 160 may signal liquid injection pump 155 to begin injecting liquid into intake 125 and/or pump annulus 175 at step 310. In some embodiments, liquid injection pump 155 may have two discrete states: liquid injection on or liquid injection off. In certain embodiments, the rate of liquid injection by liquid injection pump 155 may be adjustable in a continuum. In embodiments where the rate of liquid injection is adjustable, if motor 110 is experiencing under-load, and liquid injection is already on, then the rate of liquid injection may be increased at step 310. If VSD system 160 checks the status of motor 110 and there is no under-load (or there is an overload), then the rate of liquid injection into intake 125 and/or pump annulus 175 may be decreased and/or turned off at step 305. The sensing and adjusting cycle may be a cyclic feedback loop, as VSD system 160 senses the status of motor 110 and adjusts the flow of water injection by liquid injection pump 155 accordingly.

In the example illustrated in FIG. 3B, VSD system 160 may monitor the load on motor 110, downhole parameters such as intake pressure and fluid temperature, and/or parameters of surface equipment such as flow and wellhead pressure, at step 315. Based on the information obtained at step 315, VSD system 160 may calculate and/or estimate GLR at step 320. A maximum GLR set point may have been previously entered by a human operator and stored in the VSD system 160 parameter set, or the GLR set point may be entered or modified by an operator prior to or during operation of ESP assembly 100. At step 325, VSD system 160 may check whether the estimated or calculated GLR is above the GLR set point. If the GLR set point has not been reached, then the VSD may decrease or turn off liquid injection at step 335. Alternatively, if the GLR set point has been reached, then VSD system 160 may turn on and/or increase liquid injection at step 330. As with the example of FIG. 3A, VSD system 160 may monitor downhole conditions, for example by continuously taking readings or taking readings at intervals, to adjust the flow of liquid injected by fluid injection pump 155 as-needed to improve performance of ESP pump 130. In one example, liquid injection flow may be monitored to allow adjustment via PID control of injected liquid to allow a low volume liquid injection for consistent operation.

In some embodiments VSD system 160 may automatically adjust the speed of liquid injection pump 155. In other embodiments, VSD system 160 may prompt an operator to adjust the speed of liquid injection pump 155 and/or turn liquid injection pump 155 on or off.

The injection of liquid into pump intake 125 and/or annulus 175 of illustrative embodiments may be a dynamic injection system, whereby the flow of water into pump intake 125 and/or annulus 175 may be increased, decreased, started or stopped based on the ambient well conditions, such as the percentage of gas in the well fluid, the extent of slipping, the extent of gas locking of ESP pump 130 and/or other measures of performance of ESP pump 130. In preferred embodiments, the flow of liquid into pump intake 125, for purposes of reducing GLR, is not injected at a steady, constant rate independent of GLR, but is rather a pressure-on-demand system making use of an external load to increase head and improve fluid characteristics, so that the multistage centrifugal pump of the submersible pump assembly operates more efficiently. In some embodiments, the rate of injection of liquid into pump intake 125 is between about 50 and 500 barrels per day (bpd) for a quarter-inch capillary line, depending upon one or more of the percentage of gas by volume present in produced fluid, the temperature and/or operating speed of the pump and the quantity of fluid being pumped. In certain embodiments, the rate of injection may be between 1 and 2,000 bpd, or between 25 and 5,000 bpd.

External liquid may be injected directly into pump intake 125, such as directly into one or more intake ports 205. In some embodiments, injected liquid may not be injected directly into pump intake 125, but may instead be injected into the pump annulus 175, into perforations 170 in the well casing, liner and/or wall, at, below or in the vicinity of motor 110, or above intake 125 proximate ESP pump 130. In these latter instances, the GLR may be reduced through intake pressure maintenance, i.e., net positive suction head (NPSH). Injected liquid at or below motor 110 may assist in cooling motor 110.

Illustrative embodiments of the invention may inject liquid directly into and/or proximate an ESP pump intake or ESP motor in order to decrease (reduce) the proportion of gas in the fluid entering the pump, increase the pressure of fluid entering the pump, increase head and/or decrease slipping. Liquid may be injected as needed to counteract gas to liquid ratios in excess of about 10% and/or the point at which pump performance is affected by the presence of gas in the system. Illustrative embodiments may improve the characteristics of the pumped fluid, improve pump performance and stability, and reduce the negative effects of gas in downhole wells.

While the invention herein disclosed has been described by means of specific embodiments and applications thereof, numerous modifications and variations could be made thereto by those skilled in the art without departing from the scope of the invention set forth in the claims. The foregoing description is therefore considered in all respects to be illustrative and not restrictive. The scope of the invention is indicated by the appended claims, and all changes that come within the meaning and range of equivalents thereof are intended to be embraced therein.

What is claimed is:

1. A method for reducing a gas to liquid ratio (GLR) in a pumped fluid comprising:

pumping a gas laden fluid to a surface of a subsurface formation using a downhole electric submersible pump (ESP) assembly comprising an ESP pump and an ESP motor, monitoring one of a load of the ESP motor, intake pressure of the ESP pump, temperature of the gas laden fluid, or a combination thereof to obtain ESP assembly condition data;

determining whether a GLR of the gas laden fluid exceeds a predetermined allowable maximum based on the ESP assembly condition data;

injecting liquid from an external source into the gas laden fluid; and varying a rate that the external liquid is injected based on the GLR so determined;

wherein the load of the ESP motor is monitored and the GLR is determined to exceed the predetermined allowable maximum when the ESP motor is underloaded.

2. The method of claim 1, further comprising:

de-gassing at least a portion of the gas laden fluid produced by the downhole ESP assembly to form the liquid; and storing the liquid at the external source.

3. The method of claim 1, wherein the rate is between 25 and 5,000 barrels per day.

4. The method of claim 1, wherein the external source is a water tank on the surface of the formation.

5. The method of claim 1, wherein the external liquid comprises water, and the external liquid is injected using a capillary line and pump.

6. The method of claim 1, wherein the external liquid is water delivered to the external source by truck.

7. The method of claim 1, wherein the predetermined allowable maximum is a preset GLR set point.

8. The method of claim 1, wherein the liquid is injected directly into an inlet port of an intake of the ESP pump.

9. The method of claim 1, wherein the liquid is injected proximate to a well perforation.

10. The method of claim 1, wherein the liquid is injected downstream of an intake of the ESP pump.

11. The method of claim 1, wherein the liquid is injected one of proximate the ESP motor, upstream of the ESP motor, or a combination thereof.

12. The method of claim 1, wherein the liquid is injected upstream of an intake of the ESP pump.

* * * * *